US009784488B2

(12) United States Patent
Goel et al.

(10) Patent No.: US 9,784,488 B2
(45) Date of Patent: Oct. 10, 2017

(54) HVAC SYSTEMS, DEVICES, AND METHODS WITH IMPROVED REGULATION OF REFRIGERANT FLOW

(71) Applicant: Lennox Industries Inc., Richardson, TX (US)

(72) Inventors: Rakesh Goel, Irving, TX (US); Ian Burmania, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 421 days.

(21) Appl. No.: 14/553,921

(22) Filed: Nov. 25, 2014

(65) Prior Publication Data

US 2016/0146520 A1 May 26, 2016

(51) Int. Cl.
*F25B 41/06* (2006.01)

(52) U.S. Cl.
CPC ..... *F25B 41/062* (2013.01); *F25B 2700/197* (2013.01); *F25B 2700/21175* (2013.01)

(58) Field of Classification Search
CPC ... F25B 41/062; F25B 41/06; F25B 2341/065
See application file for complete search history.

(56) References Cited

U.S. PATENT DOCUMENTS 3,842,616 A * 10/1974 Orbesen ..... F25B 41/062 236/92 B
2006/0144076 A1* 7/2006 Daddis, Jr. ..... A47F 3/0408 62/440
2011/0314845 A1* 12/2011 Lifson ..... F25B 49/022 62/115

* cited by examiner

*Primary Examiner* — Cassey D Bauer
(74) *Attorney, Agent, or Firm* — Hubbard Johnston, PLLC

(57) ABSTRACT

Systems, devices, and methods are presented that include an expansion valve having a pin operable to regulate a primary flow of refrigerant through a flow orifice. A flange is coupled to the pin and is configured to regulate a bleed flow of refrigerant through a bleed orifice. The flange moves cooperatively with the pin, thereby enabling the bleed flow of refrigerant to vary in coordination with the primary flow of refrigerant. When the pin occludes the flow orifice, the flange forms a predetermined gap that allows a non-zero bleed flow when the primary flow of refrigerant is substantially zero. The bleed flow of refrigerant therefore flows persistently through the expansion valve during operation. Other systems, tools and methods are presented.

20 Claims, 4 Drawing Sheets

HVAC SYSTEMS, DEVICES, AND METHODS WITH IMPROVED REGULATION OF REFRIGERANT FLOW

TECHNICAL FIELD

The present disclosure relates generally to heating, ventilating, and air conditioning (HVAC) systems, and more particularly, to HVAC systems, devices, and methods with improved regulation of refrigerant flow in a closed-conduit refrigerant circuit.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling, or dehumidifying the air).

The cooling aspect of an HVAC system may utilize an evaporator that cools return air from the enclosed space. An expansion valve meters refrigerant to the evaporator while receiving the refrigerant from a condenser. The expansion valve, the evaporator, and the condenser form part of a closed-conduit refrigeration circuit of the HVAC system. There are, at times, issues with refrigerant flow that could benefit from improvements.

BRIEF DESCRIPTION OF THE DRAWINGS

Illustrative embodiments of the present disclosure are described in detail below with reference to the attached drawing figures, which are incorporated by reference herein.

Figure 1:
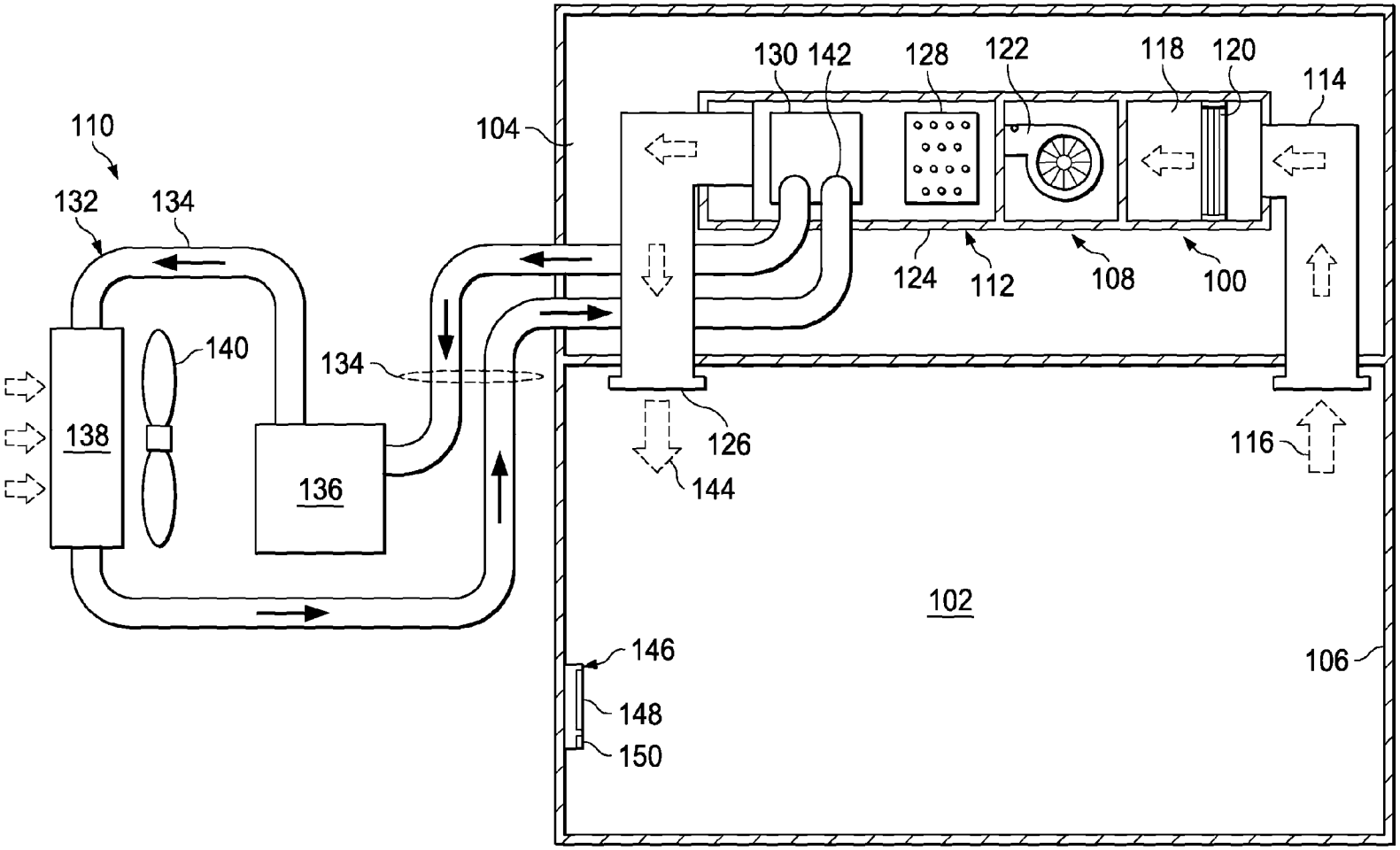
FIG. 1 is a schematic diagram of a heating, ventilating, and air conditioning (HVAC) system for providing conditioned air to a closed spaced, according to an illustrative embodiment.

The figures described above are only exemplary and their illustration is not intended to assert or imply any limitation with regard to the environment, architecture, design, configuration, method, or process in which different embodiments may be implemented.

DETAILED DESCRIPTION OF THE ILLUSTRATIVE EMBODIMENTS

Heating, ventilating, and air-conditioning (HVAC) systems commonly incorporate an expansion valve to regulate refrigerant flowing from a condenser to an evaporator. The expansion valve, the condenser, and the evaporator are components of a closed-conduit refrigerant circuit, which also includes a compressor. During start-up of the HVAC system, the compressor begins circulating refrigerant within the closed-conduit refrigerant circuit. Delivery of refrigerant to the condenser during start-up is rapid, filling the condenser quickly. If sufficient refrigerant is not allowed to drain from the condenser, pressure therein may increase beyond a pressure safety threshold, risking unreliable operation of the HVAC system or outright failure (e.g., rupture of the condenser).

The expansion valve, located immediately downstream of the condenser, controls such draining as part of regulating refrigerant flowing from the condenser to the evaporator. In general, however, expansion valves often exhibit response times too slow to allow for adequate draining of condensers during start-up. As a result, the expansion valve opens when the condenser is too close to (or has surpassed) its capacity for refrigerant. Such delay enables the condenser to exceed the safety pressure threshold, triggering pressure relief devices that may also shut the HVAC system down.

The embodiments described herein relate to systems, devices, and methods for regulating a flow of refrigerant in a heating, ventilating, and air conditioning (HVAC) system. More specifically, systems, devices, and methods are presented that include an expansion valve having a pin operable to regulate a primary flow of refrigerant through a flow orifice. A flange is associated with the pin and is configured to regulate a bleed flow of refrigerant through a bleed orifice. The flange moves cooperatively with the pin, thereby enabling the bleed flow of refrigerant to vary in coordination with the primary flow of refrigerant. When the pin occludes the flow orifice, the flange forms a predetermined gap that allows a non-zero bleed flow when the primary flow of refrigerant is substantially zero. The bleed flow of refrigerant therefore flows persistently through the expansion valve during operation, which includes start-up of the HVAC system. Other systems, tools and methods are presented.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "fluidly coupled," "fluidly connected," and "in fluid communication" refer to a form of coupling, connection, or communication related to fluids, and the corresponding flows or pressures associated with these fluids. In some embodiments, a fluid coupling, connection, or communication between two components may also describe components that are associated in such a way that a fluid can flow between or among the components. Such fluid coupling, connection, or communication between two components may also describe components that are associated in such a way that fluid pressure is transmitted between or among the components.

As used herein, the terms "hot," "warm," "cool," and "cold" refer to thermal states, on a relative basis, of refrigerant within a closed-conduit refrigeration circuit. Temperatures associated with these thermal states decrease sequentially from "hot" to "warm" to "cool" to "cold". Actual temperatures, however, that correspond to these thermal states depend on a design of the closed-conduit refrigeration circuit and may vary during operation.

Referring now to the drawings and primarily to FIG. 1, a heating, ventilating, and air conditioning (HVAC) system 100 is presented. The HVAC system 100 is for providing conditioned air to a first closed space 102, such as an interior of a building. At least a portion of the HVAC system 100 is disposed within a second closed space 104, or equipment space, or could be open on a rooftop or adjacent a building. The spaces 102, 104 may be defined by a plurality of walls 106. In this embodiment, a portion 108 of the system 100 is located within the building, i.e., within the second closed space 104, and a portion 110 outside the building.

The HVAC system 100 includes an HVAC unit 112 that is disposed within the second closed space 104, or equipment space. In other embodiments, the HVAC unit 112 is substantially located on a roof top or other location. The HVAC unit 112 includes a return air duct 114 that receives a return air 116 from the first closed space 102. The return air duct 114 may include or be coupled to a transition duct 118 that may include one or more filters 120. A blower 122 pulls the return air 116 into the return air duct 114. The blower 122 is fluidly coupled to the return air duct 114 and moves the return air 116 through the one or more filters, if present, and into a conditioning compartment 124.

The conditioning compartment 124 is fluidly coupled to the blower 122 for receiving air therefrom to be treated, i.e., the return air 118. The conditioning compartment 124 is formed with a plurality of compartment walls and may include a portion of a delivery duct 126 in some embodiments. A heating unit 128 is fluidly coupled to the conditioning compartment 124 for selectively heating air therein. A cooling unit 130 is also fluidly coupled to the conditioning compartment 124 for selectively cooling air therein. The cooling unit 130 includes a refrigerant, or working fluid. The cooling unit 130 may be an evaporator or device for receiving heat from the air flowing over the cooling unit 130. The cooling unit 130 includes at least one heat exchange surface (not explicitly shown). It will be appreciated that the order of the heating unit 128 and cooling unit 130 may be varied.

The cooling unit 130 is associated with a cooling subsystem 132. The cooling subsystem 132 is any system that is operational to develop a chilled working fluid for receiving heat within the cooling unit 130. The cooling subsystem 132 typically includes a closed-conduit circuit 134, or pathway. The refrigerant is disposed within the closed conduit circuit 134. The cooling subsystem 132 also includes a compressor 136 fluidly-coupled to the closed-conduit circuit 134 for compressing the refrigerant therein. A condenser 138 is fluidly-coupled to the closed-conduit circuit 134 downstream of the compressor 136 for cooling the refrigerant. The condenser 138 may include one or more fans 140. An expansion valve 142 is fluidly-coupled to the closed-conduit circuit 134 downstream of the condenser 138 for decreasing a pressure of the refrigerant at the cooling unit 130. The expansion valve 142 is improved and is the same or analogous to the expansion valves discussed further below. The cooling unit 130 is fluidly coupled to the closed-conduit pathway 134 for receiving the refrigerant.

Whether heated by the heating unit 128 or cooled by the cooling unit 130, the conditioning compartment 124 produces a treated air 144, or supply air, that is delivered into the first closed space 102 by the delivery duct 126. The delivery duct 126 is fluidly coupled to the conditioning compartment 124 for discharging the treated air 132 from the conditioning compartment 124 into the first closed space 102.

A control unit 146 may be disposed within the first closed space 102 and optionally include an input device and a display, such as a touch-screen display 148 and a speaker 150 for audible alerts or instructions. The control unit 146 is communicatively coupled (i.e., in communication through wires, wireless, or other means) with the blower 122, the heating unit 128, the cooling unit 130 (or cooling subsystem), or other devices to be monitored or controlled. The control unit 146 may include a thermostat for providing control signals to the blower 122, heating unit 128, or cooling unit 130 (or cooling subsystem) in response to a measured temperature in the first closed space 102.

Figure 2:
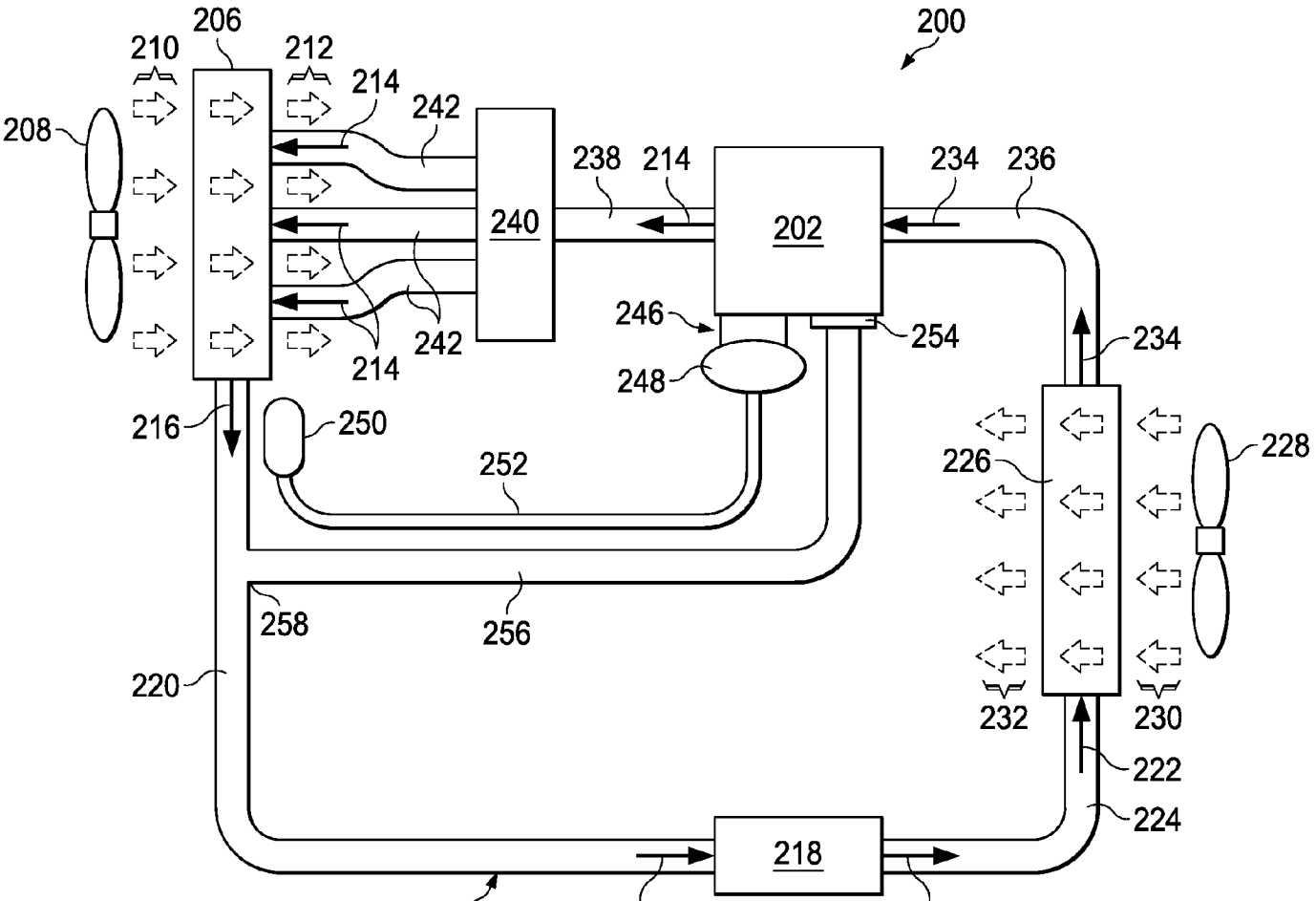
FIG. 2 is a schematic diagram of an HVAC system having an expansion valve for regulating a flow of refrigerant within the HVAC system, according to an illustrative embodiment.

Now referring primarily to FIG. 2, a schematic diagram is presented of a heating, ventilating, and air conditioning (HVAC) system 200 having an expansion valve 202 for regulating a flow of refrigerant within the HVAC system 200, according to an illustrative embodiment. The HVAC system 200 includes a closed-conduit refrigeration circuit 204. The closed-conduit refrigeration circuit 204 is shown in FIG. 2 by solid lines that represent fluid coupling between components of the closed-conduit refrigeration circuit 204, such as the expansion valve 202. The solid lines correspond to individual conduits of refrigerant and arrows 214, 216, 222, 234 along the solid lines in FIG. 2 indicate the flow of refrigerant, if present in the HVAC system 200.

The closed-conduit refrigeration circuit 204 includes an evaporator 206 for enabling a cooling capacity of the HVAC system 200. The evaporator 206 typically includes at least one evaporator fan 208 to circulate a return air 210 across one or more heat-exchange surfaces of the evaporator 206. The evaporator 206 is configured to transfer heat from the return air 210 to refrigerant therein. The return air 210 is drawn in from a conditioned space, which may be analogous to the first closed space 102 of FIG. 1, and exits the evaporator 206 as a cooled airflow 212. Concomitantly, a low-pressure liquid refrigerant 214 enters the evaporator 206 and leaves as a low-pressure gas refrigerant 216.

The closed-conduit refrigeration circuit 204 also includes a compressor 218 fluidly-coupled to the evaporator 206 via a suction line 220. The suction line 220 is operable to convey the low-pressure gas refrigerant 216 from the evaporator 206 to the compressor 218. During operation, the compressor 218 performs work on the low-pressure gas refrigerant 216, thereby generating a high-pressure gas refrigerant 222. The high-pressure gas refrigerant 222 exits the compressor 218 through a discharge line 224. In some embodiments, the compressor 218 includes a plurality of compressors that form a tandem configuration within the closed-conduit refrigeration circuit 204. In such embodiments, the plurality of compressors may be fluidly-coupled to the suction line 220 through a common suction manifold and fluidly-coupled to the discharge line 224 through a common discharge manifold. Other types of fluid couplings are possible.

The closed-conduit refrigeration circuit 204 also includes a condenser 226 that is fluidly-coupled to the compressor 218 via the discharge line 224. The condenser 226 typically includes at least one condenser fan 228 to circulate a non-conditioned air 230 across one or more heat exchange surfaces of the condenser 226. The condenser 226 is configured to transfer heat from refrigerant therein to the non-conditioned air 230. The non-conditioned air 230 exits the condenser 226 as a warmed airflow 232. Concomitantly, the high-pressure gas refrigerant 222 enters the condenser 226 and leaves as a high-pressure liquid refrigerant 234. In some embodiments, the condenser 226 includes a microchannel condenser. A microchannel condenser typically uses an array of flat aluminum tubes with multiple micro-channels, fins between the tubes and two refrigerant manifolds at each end of the tubes. The design helps reduce refrigerant charge for similar coil efficiency.

The closed conduit refrigeration circuit 204 includes a liquid line 236 and a refrigerant line 238. The liquid line 236 fluidly-couples the condenser 226 to the expansion valve 202 and is operable to convey the high-pressure liquid refrigerant 234 from the condenser 226 to the expansion valve 202. The refrigerant line 238 fluidly-couples the expansion valve 202 to the evaporator 206 and is operable to convey the low-pressure liquid refrigerant 214 from the expansion valve 202 to the evaporator 206. In some embodiments, a distributor 240 splits the refrigerant line 238 into a plurality of branches 242. These branches 242 transition into a plurality of short heat-transfer circuits (not explicitly shown) upon entry into the evaporator 206. In such embodiments, the plurality of short heat transfer circuits may prevent large drops in pressure that might otherwise occur if a single, long circuit were used.

The improved expansion valve 202 serves to regulate the flow of refrigerant through the HVAC system 200 and to control a conversion of high-pressure liquid refrigerant 234 into low-pressure liquid refrigerant 214. Moreover, the expansion valve 202 favorably processes start-up of the closed-conduit refrigeration circuit 204. The improved expansion valve may also help reduce cycling of the thermal expansion valve during partial load by limiting the refrigerant flow through the bleed valve.

As described in more detail further below, the expansion valve 202 has a pin and a flange therein (e.g., see 312 and 320 of FIGS. 3A-3B). The pin is configured to regulate a primary flow of refrigerant through a flow orifice of the expansion valve. The flange is configured to regulate a bleed flow of refrigerant through a bleed orifice of the expansion valve. In some embodiments, the pin and the flange are formed of a single body. It will be appreciated that the expansion valve 202 is configured to split the flow of refrigerant received from the liquid line 236 into the primary flow of refrigerant and the bleed flow of refrigerant. The bleed flow of refrigerant is typically less in magnitude than the primary flow of refrigerant. The pin, to regulate the primary flow of refrigerant through the flow orifice, is operable to move between a closed position, where the flow orifice is occluded by the pin, and an open position, where the flow orifice is substantially unoccluded by the pin. The flange is coupled to the pin such that the bleed flow of refrigerant varies in coordination with the primary flow of refrigerant. The bleed flow of refrigerant is non-zero when the pin is in the closed position (i.e., when the flow orifice is occluded by the pin).

The expansion valve 202 includes an actuator 246 coupled to the pin and configured to move the pin in response to a refrigerant temperature. In further embodiments, the actuator 246 includes a chamber 248 having a diaphragm coupled to the pin (e.g., see 332 of FIG. 3A). The diaphragm partitions the chamber 248 into a first compartment and a second compartment. In such embodiments, the actuator 246 also includes sensory bulb 250 and a tube 252 coupling the chamber 248 to the sensory bulb 250. The sensory bulb 250 is thermally-coupled to the suction line 220 in close proximity to an output of the evaporator 206. The tube 252, commonly a capillary transmission tube, enables fluid communication between the first compartment of the chamber 248 and the sensory bulb 250. A fluid is disposed within a volume defined by the first compartment, the sensory bulb 250, and the tube 252. The fluid is operable to displace the diaphragm in response to thermal energy entering or exiting the sensory bulb 250. Such displacement adjusts a position of the pin and the coupled flange, thereby altering the primary flow of refrigerant through the flow orifice and the bleed flow of refrigerant through the bleed orifice. The expansion valve 202 is therefore able to regulate the flow of refrigerant through the HVAC system 200 in response to the refrigerant temperature of the low-pressure gas refrigerant 216 exiting the evaporator 206.

In some embodiments, the expansion valve 202 includes a pressure equalizer port 254 fluidly-coupled to the suction line 220 of the closed-conduit refrigeration circuit 204. In such embodiments, the pressure equalization port 254 enables the expansion valve 202 to sense a refrigerant pressure of the low-pressure gas refrigerant 216 exiting the evaporator 206. As will be described in relation to FIG. 3A, the sensed refrigerant pressure is utilized by the expansion valve 202 to adjust the position of the pin and the coupled flange, thereby altering the primary flow of refrigerant through the flow orifice and the bleed flow of refrigerant through the bleed orifice. Such alteration aids in regulating the flow of refrigerant through the HVAC system 200. The pressure equalizer port 254 may be fluidly-coupled to the suction line 220 via a pressure equalization line 256. In such configurations, the pressure equalization line 256 forms a junction 258 with the suction line 220 in close proximity to the output of the evaporator 206.

It will be appreciated that the expansion valve 202, in some embodiments, may include both the actuator 248 and the pressure equalization port 254, as depicted in FIG. 2. In such embodiments, the refrigerant temperature and the refrigerant pressure are used in combination to regulate the flow of refrigerant in the HVAC system 200. For embodiments that incorporate both the sensory bulb 250 and the pressure equalization line 256—such as that depicted in FIG. 2—the junction 258 is typically adjacent, but downstream of the sensory bulb 250. However, other arrangements of the junction 258 and the sensory bulb 250 are possible.

The HVAC system 200 includes a refrigerant disposed therein. The closed-conduit refrigeration circuit 204 serves to convey refrigerant between components of the HVAC system 200 (e.g., the expansion valve 202, the evaporator 206, the compressor 218, the condenser 226, etc.). Individual components of the closed-conduit refrigeration circuit 204 then manipulate the refrigerant to generate the cooled airflow 212.

In operation, the evaporator 206 receives the low-pressure liquid refrigerant 214 as a cold fluid from the expansion valve 202 via the refrigerant line 238 and, if present, the distributor 240 and associated plurality of branches 242. The cold, low-pressure liquid refrigerant 214 flows through the evaporator 206 and, while therein, absorbs heat from the return air 210. Such heat absorption is aided by the at least one evaporator fan 208 and the one or more heat-exchange surfaces of the evaporator 206. The at least one evaporator fan 208 enables a forced convection of return air 210 across the one or more heat-exchange surfaces of the evaporator 206. Absorption of heat by the cold, low-pressure liquid refrigerant 214 induces a conversion from liquid to gas (i.e., boiling) within the evaporator 206. The cold, low-pressure liquid refrigerant 214 therefore leaves the evaporator 206 as a warm, low-pressure gas refrigerant 216. Concomitantly, the return air 210 exits the evaporator 206 as the cooled airflow 212.

Conversion of the cold, low-pressure liquid refrigerant 214 into the warm, low-pressure gas refrigerant 216 often produces a superheated refrigerant whose temperature exceeds a saturated boiling point. Superheated refrigerant is generated when warm, low-pressure gas refrigerant 216 continues to absorb heat after changing from liquid to gas. Such absorption occurs predominantly within the evaporator 206, but may also occur within the suction line 220. A degree of superheat is typically measured in terms of temperature (e.g., ° F., ° C., K) and refers to a difference in temperature between the superheated refrigerant and its saturated boiling point.

After leaving the evaporator 206, the warm, low-pressure gas refrigerant 216 traverses the suction line 220 of the closed-circuit refrigeration circuit 204 and enters the compressor 218. The compressor 218 performs work on the warm, low-pressure gas refrigerant 216, producing a hot, high-pressure gas refrigerant 222. The hot, high-pressure gas refrigerant 222 exits the compressor 218 via the discharge line 224 and travels to the condenser 226. The hot, high-pressure gas refrigerant 222 flows through the condenser 226, and while therein, transfers heat to the non-conditioned air 230. Such heat transfer may be assisted by the at least one condenser fan 228 and the one or more heat-exchange surfaces of the condenser 226. The at least one condenser fan 228 enables a forced convection of non-conditioned air 230 across the one or more heat-exchange surfaces of the condenser 226. Loss of heat from the hot, high-pressure gas refrigerant 222 induces a conversion from gas to liquid (i.e., condensing) within the condenser 226. The hot, high-pressure gas refrigerant 222 therefore leaves the condenser 226 as a warm, high-pressure liquid refrigerant 234. Concomitantly, the non-conditioned air 230 exits the condenser 130 as the warmed airflow 232.

Conversion of the hot, high-pressure gas refrigerant 222 into the warm, high-pressure liquid refrigerant 234 often produces a subcooled refrigerant whose temperature is below a saturated condensation point. Subcooled refrigerant is generated when warm, high-pressure liquid refrigerant 234 continues to lose heat after changing from gas to liquid. Such loss occurs predominantly within the condenser 226, but may also occur within the liquid line 236. A degree of subcooling is typically measured in terms of temperature (e.g., ° F., ° C., K) and refers to a difference in temperature between the subcooled refrigerant and its saturated condensing point.

After leaving the condenser 226, the warm, high-pressure liquid refrigerant 234 flows through the liquid line 236 to reach the expansion valve 202. As explained more below, the warm, high pressure liquid refrigerant 234 is split in the expansion valve 202 into at least the primary flow, which passes through the flow orifice, and the bleed flow, which passes through the bleed orifice. Passage of the warm, high pressure liquid refrigerant 234 through the flow orifice (and to a lesser extent, the bleed orifice) induces a lowering of pressure and temperature that generates the cold, low-pressure liquid refrigerant 214. A position of the pin relative the flow orifice serves to regulate flow through the expansion valve 202, and hence, generation of the cold, low-pressure liquid refrigerant 214. The cold, low-pressure liquid refrigerant 214 is then conveyed to the evaporator 206 by the refrigerant line 238 (and, if present, the distributor 240 and associated plurality of branches 242).

It will be appreciated that the closed-conduit refrigeration circuit 204 circulates the refrigerant to allow repeated processing by the evaporator 206, the compressor 218, the condenser 222, and the expansion valve 202. Repeated processing, or cycles, enables the HVAC system 200 to continuously produce the cooled airflow 212 during operation. During such cycling, the expansion valve 202 regulates the flow of refrigerant through the HVAC system 200, which includes receiving the warm, high-pressure liquid refrigerant 234 from the condenser 226 and metering the cold, low-pressure liquid refrigerant 214 to the evaporator 206. The former flow influences the degree of subcooling and the latter flow influences the degree of superheat. Higher degrees of superheat reduce a risk that the warm, low-pressure gas refrigerant 216 will enter the compressor 218 with a non-zero liquid fraction. Higher degrees of subcooling reduce a risk that the warm, high-pressure liquid refrigerant 234 will enter the expansion valve 202 with a non-zero gas fraction.

Figure 3A:
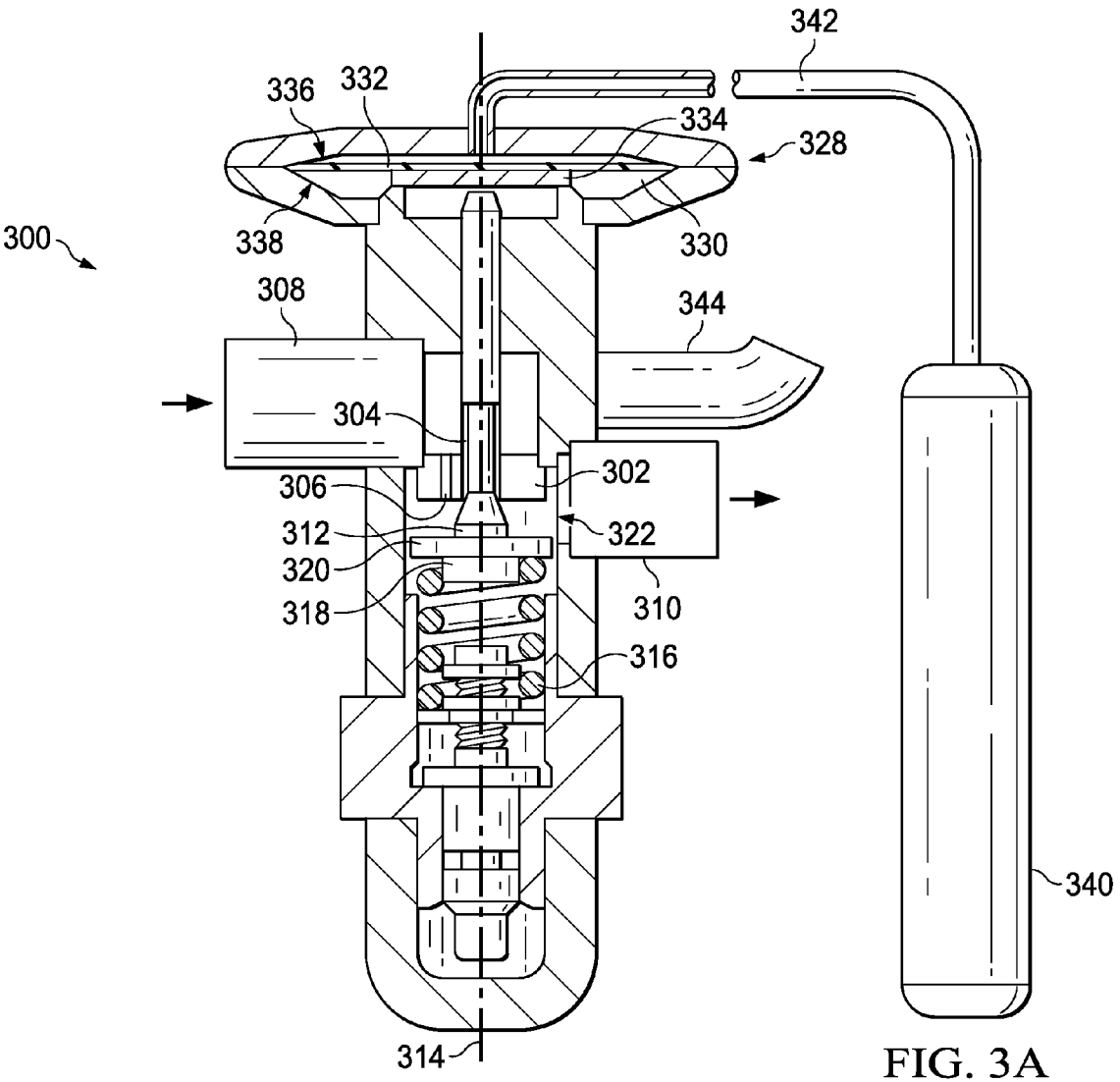
FIG. 3A is a schematic diagram, with a portion shown in cross-section, of an expansion valve for regulating a flow of refrigerant within an HVAC system, according to an illustrative embodiment.
Figure 3B:
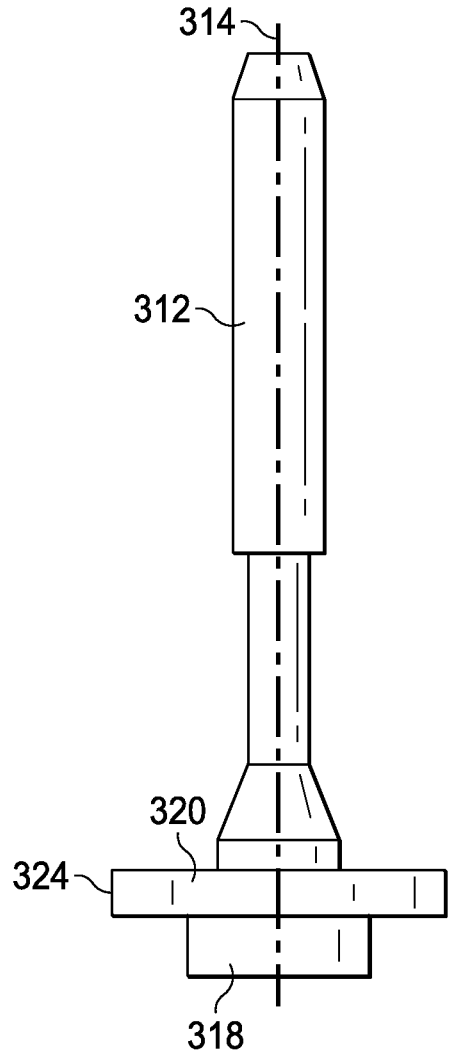
FIG. 3B is an exploded view of a pin and a spring in which an annular protrusion on the pin serves as a flange, according to an illustrative embodiment.
Figure 3B:
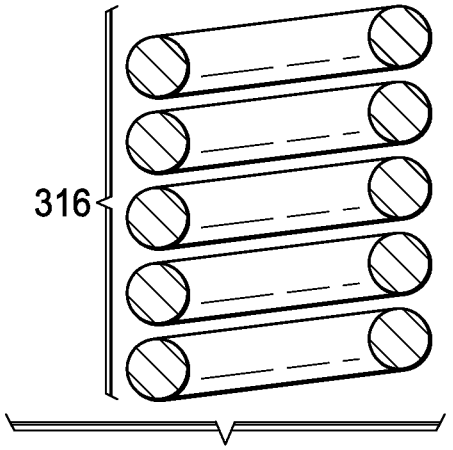

Now referring primarily to FIG. 3A, a schematic diagram is presented, with a portion shown in cross-section, of an expansion valve 300 for regulating a flow of refrigerant within a heating, ventilating, and air conditioning (HVAC) system, according to an illustrative embodiment. The expansion valve 300 depicted in FIG. 3A may be analogous to the expansion valve 202 described in relation to FIG. 2. The expansion valve 300 includes a body 302 formed with a flow orifice 304 and a bleed orifice 306. The flow orifice 304 and the bleed orifice 306 are operable to convey the flow of refrigerant from an inlet port 308 to an outlet port 310. The inlet port 308 is configured to fluidly-couple the expansion valve 300 to a condenser of the HVAC system, which may be a microchannel condenser. The outlet port 310 is configured to fluidly-couple the expansion valve 300 to an evaporator of the HVAC system.

The expansion valve 300 also includes a pin 312 having a longitudinal axis 314. The pin 312 is operable to control a primary flow of refrigerant through the flow orifice 304, which includes varying an occlusion of the flow orifice 304. The pin 312 is operatively movable along the longitudinal axis 314 between a closed position and an open position. The closed position and the open position define terminal points of a stroke of the pin 312, or pin stroke. In the closed position, the pin 312 occludes the flow orifice 304. Such occlusion may involve the pin 312 sealingly engaging the body 302 along one or more surfaces that define the flow orifice 304. In the open position, the pin 312 substantially unoccludes the flow orifice 304. Motion of the pin 312 within the pin stroke alters the occlusion of the flow orifice 304. As the pin 312 moves from the closed position to the open position, the occlusion progressively decreases. As the pin 312 moves from the open position to the closed position, the occlusion progressively increases. In FIG. 3A, the pin 312 is depicted at a point along the pin stroke between the closed position and the open position.

In some embodiments, the expansion valve 300 includes a spring 316 arranged within the expansion valve 300 so as to bias the pin 312 in the closed position. In such embodiments, a spring guide 318 is typically operable to center the spring 316 along the longitudinal axis 314 of the pin 312. In some embodiments, the pin 312 is disposed through the flow orifice 304, as shown in FIG. 3A. This depiction, however, is not intended as limiting. For example, and without limitation, the pin 312 could be configured to sealingly engage the body 302 proximate the flow orifice 304, but not extend therethrough. Other configurations are possible.

The expansion valve 300 also includes a flange 320 that is coupled to the pin 312. The flange 320 is operable to impede a bleed flow of refrigerant exiting the bleed orifice 306. Coupling between the flange 320 and the pin 312 enables the flange 320 to coordinate motion with the pin 312. Thus, when the pin 312 is moved between the closed position and the open position, the flange 320 moves cooperatively with the pin 312. When the pin 312 is in the closed position, the flange 320 is positioned to define a predetermined gap 322 adjacent the bleed orifice 306. When the pin 312 is in the open position, the flange 320 is positioned to substantially unocclude (allows substantially unhindered flow) the bleed orifice. The predetermined gap 322 allows the expansion valve 300 to maintain a non-zero bleed flow when the pin 312 occludes the flow orifice 304. A magnitude of the non-zero bleed flow is controlled via physical aspects of the predetermined gap 322, which include size, shape, and orientation. Other physical aspects are possible. The predetermined gap 322 minimizes pressure spikes during start-up.

In some embodiments, the pin 312 and the flange 320 are formed of a single body, as depicted in FIG. 3A. However, this depiction is not intended as limiting. The pin 312 and the flange 320 may be formed using a plurality of bodies. FIG. 3B presents an exploded view of a pin 312 and a spring 316 in which an annular protrusion 324 on the pin 312 serves as a flange 320, according to an illustrative embodiment. The pin 312 and the flange 320 (or annular protrusion 324) are formed using a common body, which includes a spring guide 318. The pin 312 and the flange 320 shown FIG. 3B are analogous to the pin 312 and flange 320 shown in FIG. 3A. It will be appreciated by one skilled in the art given the concepts herein that other numbers and configurations of bodies are possible to form the pin 312 and the flange 320. The flange 320 may also be defined by shapes different than the annular protrusion shown in FIGS. 3A-3B. For example, and without limitation, the flange 320 may be defined by tabs, flutes, and bosses. Other shapes are possible.

Referring again primarily to FIG. 3A, the expansion valve 300 also includes an actuator 328 coupled to the pin 312 that is configured to move the pin 312 in response to a refrigerant temperature. Such movement includes motion of the flange 320. The refrigerant temperature is typically sensed adjacent an output of the evaporator. In some embodiments, the actuator 328 includes a chamber 330 having a diaphragm 332 coupled to the pin 312. This coupling may involve other elements, such as a flexible plate 334. The diaphragm 332 partitions the chamber 330 into a first compartment 336, which is at or near a minimum in the depiction, and a second compartment 338. In such embodiments, the actuator 328 also includes a sensory bulb 340. A tube 342, commonly a capillary transmission tube, couples the chamber 330 to the sensory bulb 340 and enables fluid communication between the first compartment 336 and the sensory bulb 340. A fluid (not explicitly shown) is disposed within a volume defined by the first compartment 336, the sensory bulb 340, and the tube 342. The fluid is typically the same as a refrigerant used in the HVAC system, although other fluids are possible. The fluid is operable to displace the diaphragm 332 in response to thermal energy entering and exiting the sensory bulb 340.

In some embodiments, the expansion valve 300 includes a pressure equalizer port 344 configured to receive refrigerant from a suction line of the HVAC system. In such embodiments, the pressure equalizer port 344 is operable to convey refrigerant into the second compartment 338 and against the diaphragm 332, thereby applying a refrigerant pressure. In some embodiments, the expansion valve 300 is fluidly-coupled to a microchannel condenser. In these embodiments, the inlet port 308 receives refrigerant from the microchannel condenser, which typically includes receiving refrigerant from a liquid line of the HVAC system.

In operation, a refrigerant is disposed within the expansion valve 300, which includes flowing refrigerant from the inlet port 308 to the outlet port 310. Such flow may correspond to the flow of refrigerant within the HVAC system. A presence of refrigerant in the expansion valve 300 enables the pin 312 to fluidly-couple to the flow orifice 304 and the flange 320 to fluidly-couple to the bleed orifice 306. Such fluid coupling includes impeding refrigerant flowing through the flow orifice 304 (i.e., with the pin 312) and the bleed orifice 306 (i.e., with the flange 320). Refrigerant traversing the inlet port 308 enters the flow orifice 304 and the bleed orifice 306 thereby forming, respectively, the primary flow of refrigerant and the bleed flow of refrigerant.

When the pin 312 is in the closed position, the primary flow of refrigerant and exhibits a minimum magnitude, i.e., a minimum primary flow. Because the pin 312 occludes the flow orifice 304 in the closed position, the minimum primary flow is substantially zero. However, the flange 320 forms the predetermined gap 322 that serves to impede (but not stop) the bleed flow of refrigerant. Thus, when the pin 312 is in the closed position, the bleed flow of refrigerant corresponds to the non-zero bleed flow.

When the pin 312 is in the open position, the primary flow of refrigerant exhibits a maximum magnitude, i.e., a maximum primary flow. The bleed flow of refrigerant exhibits a magnitude corresponding to the open position of the pin 312, which may be a maximum bleed flow. However, the maximum bleed flow may occur at other positions of the pin stroke, including the closed position.

As the pin 312 moves between the closed position and the open position, the primary flow of refrigerant and the bleed flow of refrigerant vary in magnitude. More specifically, the primary flow of refrigerant varies between the minimum primary flow, which is substantially zero, and the maximum primary flow. The bleed flow of refrigerant varies between the non-zero bleed flow and a magnitude corresponding to the open position of the pin 312. Because the flange 320 moves cooperatively with the pin 312, the bleed flow of refrigerant is coordinated with the primary flow of refrigerant.

When the pin 312 is in the open position, the primary flow of refrigerant and exhibits the maximum primary flow and the expansion valve 300 operates at "full load". The expansion valve 300, however, can transition into "part load" operation if the pin 312 moves along the pin stroke towards the closed position. "Part load" operation corresponds to that portion of the pin stroke where the primary flow of refrigerant exhibits a reduced, non-zero magnitude relative to the maximum primary flow. For example, and without limitation, "part load" operation may correspond to that portion of the pin stroke where the primary flow of refrigerant is 50% or below that of the maximum primary flow. If the pin 312 moves into the closed position, the expansion valve 300 transitions into "no load" operation. In "no load" operation, the primary flow of refrigerant substantially ceases, yet the bleed flow of refrigerant persists (i.e., exhibits the non-zero bleed flow).

During operation, a plurality of forces acts on the pin 312 to determine the position of the pin 312 within the pin stroke. Refrigerant flowing from the inlet port 308 through the flow orifice 304 impinges on the pin 312, biasing the pin 312 towards the open position and contributing to an opening force. The actuator 328 also contributes to the opening force depending on the refrigerant temperature, which is typically sensed proximate the output of the evaporator. For embodiments where the actuator 328 incorporates the diaphragm 332, such as that illustrated in FIG. 3A, the diaphragm 328 flexes in response to thermal energy transferring into or out of the fluid. Such transfer typically occurs at the sensory bulb 340, which is thermally-coupled to the suction line adjacent the output of the evaporator. Because the fluid is sealed in the volume defined by the first compartment 336, the sensory bulb 340, and the tube 342, thermal energy entering the fluid causes an increase in pressure that displaces the diaphragm 332 towards the body 302. Conversely, thermal energy leaving the fluid causes a decrease in pressure that allows the diaphragm to relax away from the body 302. By virtue of its coupling to the pin 312, the diaphragm 332 contributes to the opening force when thermal energy enters the fluid. Such contribution decreases in magnitude when thermal energy leaves the fluid.

The spring 316 biases the pin 312 towards the closed position and contributes to a closing force. A strength of such bias increases as the pin 312 moves towards the open position, i.e., the spring 316 becomes increasingly compressed. An initial spring bias is typically determined by selecting an initial compression of the spring 316. The pressure equalizer port 344, if present, may also contributes to the closing force depending on the refrigerant pressure, which is typically sensed proximate the output of the evaporator. The pressure equalizer port 344 is fluidly-coupled to the diaphragm 332 via the second compartment 338. Such fluid-coupling allows the refrigerant pressure to be conveyed from the pressure equalizer port 344, through the second compartment 338, and against the diaphragm 332. If the expansion valve 300 is fluidly-coupled to a suction line of the HVAC system, such as the expansion valve 202 of FIG. 2, the refrigerant pressure is substantially equal to that exiting the evaporator. In general, however, the refrigerant pressure displaces the diaphragm away from the body 302 which, by virtue of its coupling to the pin 312, contributes to the closing force. This contribution increases or decreases as the refrigerant pressure, respectively, increases or decreases.

As refrigerant flows through the expansion valve 300, the pin 312 translates along the pin stroke until an equilibrium point is reached where the opening force balances the closing force. The equilibrium point changes dynamically in response to the refrigerant temperature and, in some embodiments, the refrigerant pressure, may both be continuously sensed. When integrated into the HVAC system, it will be appreciated that the expansion valve 300 translates the pin 312 to meter refrigerant to the evaporator and to maintain a substantially constant degree of superheat therein. Thus, the expansion valve 300 sustains HVAC operating efficiencies while transitioning between "full load", "part load", and "no load" (i.e., as cooling demands on the evaporator change). The expansion valve 300 also influences the degree of subcooling in the condenser. Translation of the pin 312 along the pin stroke alters refrigerant flow through the inlet port 308, which due to fluid-coupling with the condenser, varies a residence time of refrigerant flowing therein.

The flange 320, in cooperation with the pin 312 and the bleed port 306, allows the expansion valve 300 to produce the non-zero bleed flow during "no load" operation. The non-zero bleed flow is particularly beneficial during start-up of the HVAC system when the condenser rapidly fills with refrigerant. The expansion valve 300 often has a response time that is greater than a fill time of the condenser. Thus, the expansion valve 300 may remain in "no load" operation even if the condenser reaches (or surpasses) its capacity for refrigerant. The non-zero bleed flow enables the condenser to continuously expel refrigerant during start-up, despite the primary flow of refrigerant through the expansion valve 300 being substantially zero. As a result, the condenser is able to operate below a pressure safety threshold. Without the non-zero bleed flow, the pressure safety threshold would quickly be exceeded, risking unreliable operation of the HVAC system or outright failure (e.g., rupture of the condenser).

As the pin 312 translates along the pin stroke away from the closed position, the expansion valve 300 enters into "part load" or "full load" operation. During "part load" operation, the flange 300 varies the bleed flow of refrigerant in coordination with the primary flow of refrigerant. Such coordination is predetermined so that the degree of superheat in the compressor and the degree of subcooling in the condenser maintain or approach target values. These target values may not be attainable if the bleed flow of refrigerant is otherwise unimpeded by the flange 320. For example, and without limitation, the flange 320 may impede the bleed flow of refrigerant during "part load" operation to ensure that refrigerant flowing through the condenser achieves a target flow rate. If, instead, the bleed flow of refrigerant were unimpeded, a higher flow rate would occur, lowering the degree of subcooling in the condenser.

According to an illustrated embodiment, a method for regulating a flow of refrigerant within a heating, ventilating, and air conditioning system includes the step of flowing refrigerant through an expansion valve having a flow orifice and a bleed orifice. The method also includes the step of impeding, with a pin, a primary flow of refrigerant through the flow orifice and the step of impeding, with a flange coupled to the pin, a bleed flow of refrigerant through the bleed orifice. The primary flow of refrigerant and the bleed flow of refrigerant are formed in the expansion valve while flowing refrigerant therethrough, which may involve splitting the flow of refrigerant with a body containing the flow orifice and the bleed orifice. The method includes the step of moving the pin between a closed position and an open position. The flange, by virtue of its coupling to the pin, moves cooperatively with the pin when the pin moves between the closed position and the open position. The bleed flow of refrigerant through the bleed orifice therefore varies in coordination with the primary flow of refrigerant through the flow orifice. In the closed position, the pin occludes the flow orifice and positions the flange adjacent the bleed orifice to form a predetermined gap. In the open position, the pin substantially unoccludes the flow orifice and the flange substantially unoccludes the bleed orifice.

In some embodiments, the pin and the flange are formed of a single body. In some embodiments, the step of flowing refrigerant through an expansion valve includes receiving refrigerant from a microchannel condenser. In some embodiments, the method includes the step of measuring a refrigerant temperature proximate an output of an evaporator and the step of adjusting a position of the pin and a position of the flange in response to the measured temperature. In some embodiments, the method includes the step of measuring a change in refrigerant pressure as refrigerant flows through the evaporator and the step of adjusting the position of the pin and the position of the flange in response to the measured change in refrigerant pressure.

In some embodiments, the method includes the step of altering a pressure of a sealed fluid by exchanging thermal energy between refrigerant exiting the evaporator and the sealed fluid. In such embodiments, the method includes the step of, while altering, applying the pressure of the sealed fluid against a diaphragm to generate a variable force. The diaphragm may define a displaceable surface of a closed volume that contains the sealed fluid. The method also includes the step of adjusting the position of the pin and the position of the flange by transmitting the variable force from the diaphragm to the pin.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

In the detailed description of the illustrative embodiments above, reference is made to the accompanying drawings that form a part hereof. The embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The detailed description is, therefore, not to be taken in a limiting sense, and the scope of the illustrative embodiments is defined only by the appended claims.

In the drawings and description above, like parts are typically marked throughout the specification and drawings with the same reference numerals or coordinated numerals. The drawing figures are not necessarily to scale. Certain features of the illustrative embodiments may be shown exaggerated in scale or in somewhat schematic form and some details of conventional elements may not be shown in the interest of clarity and conciseness.

The invention claimed is:

1. A heating, ventilating, and air conditioning system, the system comprising:

a closed-conduit refrigeration circuit having an evaporator fluidly-coupled to a compressor and fluidly-coupled to a condenser; and an expansion valve fluidly-coupled to the evaporator and the condenser, the expansion valve having an inlet port and an outlet port, the expansion valve comprising:

a pin configured to regulate a primary flow of refrigerant through a flow orifice of the expansion valve, a flange proximate a bleed orifice configured to regulate a bleed flow of refrigerant through the bleed orifice of the expansion valve, wherein the pin, to regulate the primary flow of refrigerant through the flow orifice, is operable to move between a closed position, where the flow orifice is occluded by the pin, and an open position, where the flow orifice is substantially unoccluded by the pin, wherein the flange is coupled to the pin such that the bleed flow of refrigerant varies in coordination with the primary flow of refrigerant, and wherein the flange forms a predetermined gap when the pin is in the closed position such that the bleed flow of refrigerant from the inlet port to the outlet port is non-zero when the pin is in the closed position.

2. The system of claim 1, wherein the compressor comprises a plurality of compressors that form a tandem configuration within the closed-conduit refrigeration circuit.

3. The system of claim 1, wherein the condenser comprises a microchannel condenser.

4. The system of claim 1, further comprising a refrigerant disposed therein.

5. The system of claim 1, wherein the pin and the flange are formed of a single body.

6. The system of claim 1, wherein the expansion valve comprises an actuator coupled to the pin and configured to move the pin in response to a refrigerant temperature.

7. The system of claim 1, wherein the expansion valve comprises a pressure equalizer port fluidly-coupled to a suction line of the closed-conduit refrigeration circuit.

8. A expansion valve for regulating a flow of refrigerant within a heating, ventilating, and air conditioning system, the expansion valve comprising:

a body formed with a flow orifice, a bleed orifice, and having an inlet port and an outlet port;

a pin having a longitudinal axis, the pin operatively movable between an open position and a closed position along the longitudinal axis;

a flange coupled to the pin;

an actuator coupled to the pin and configured to move the pin in response to a refrigerant temperature;

wherein the pin, in the closed position, occludes the flow orifice and positions the flange adjacent the bleed orifice to define a predetermined gap that allows a non-zero refrigerant flow from the inlet port to the outlet port through the bleed orifice while the pin is in the closed position; and wherein the pin, in the open position, substantially unoccludes the flow orifice and positions the flange to substantially unocclude the bleed orifice.

9. The expansion valve of claim 8, wherein the pin and the flange are formed of a single body.

10. The expansion valve of claim 8, further comprising:

a refrigerant disposed therein;

wherein the pin is fluidly coupled to the flow orifice;

wherein the flange is fluidly coupled to the bleed orifice; and wherein a bleed flow of refrigerant through the bleed orifice and a primary flow of refrigerant through the flow orifice are varied in coordination as the pin is moved between the closed position and the open position.

11. The expansion valve of claim 8, wherein the actuator comprises:

a chamber having a diaphragm coupled to the pin, the diaphragm to partition the chamber into a first compartment and a second compartment;

a sensory bulb;

a tube coupling the chamber to the sensory bulb, the tube to enable fluid communication between the first compartment of the chamber and the sensory bulb;

a fluid disposed within a volume defined by the first compartment, the sensory bulb, and the tube; and wherein the fluid is operable to displace the diaphragm in response to thermal energy entering or exiting the sensory bulb.

12. The expansion valve of claim 8, further comprising a pressure equalizer port configured to receive refrigerant from a suction line of the heating, ventilating, and air conditioning system.

13. The expansion valve of claim 8, further comprising a spring, the spring arranged within the expansion valve so as to bias the pin in the closed position.

14. The expansion valve of any of claim 8, wherein the expansion valve is fluidly-coupled to a microchannel condenser.

15. A method for regulating a flow of refrigerant within a heating, ventilating, and air conditioning system, the method comprising:

flowing refrigerant through an expansion valve from an inlet port to an outlet port, wherein the expansion valve comprises a flow orifice and a bleed orifice;

impeding, with a pin, a primary flow of refrigerant through the flow orifice;

impeding, with a flange coupled to the pin, a bleed flow of refrigerant through the bleed orifice;

moving the pin between a closed position and an open position;

wherein the flange moves cooperatively with the pin when the pin moves between the closed position and the open position;

wherein, in the closed position, the pin occludes the flow orifice and positions the flange adjacent the bleed orifice to form a predetermined gap allowing non-zero flow of refrigerant from the inlet port to an outlet port through the bleed orifice; and wherein, in the open position, the pin substantially unoccludes the flow orifice and the flange substantially unoccludes the bleed orifice.

16. The method of claim 15, wherein the pin and the flange are formed of a single body.

17. The method of claim 15, further comprising:

measuring a refrigerant temperature proximate an output of an evaporator; and adjusting a position of the pin and a position of the flange in response to the measured refrigerant temperature.

18. The method of claim 15, further comprising:

altering a pressure of a sealed fluid by exchanging thermal energy between refrigerant exiting the evaporator and the sealed fluid;

while altering, applying the pressure of the sealed fluid against a diaphragm to generate a variable force; and adjusting the position of the pin and the position of the flange by transmitting the variable force from the diaphragm to the pin.

19. The method of claim 15, further comprising:

measuring a change in refrigerant pressure as refrigerant flows through the evaporator; and adjusting the position of the pin and the position of the flange in response to the measured change in refrigerant pressure.

20. The method of claim 15, wherein flowing refrigerant through an expansion valve comprises receiving refrigerant from a microchannel condenser.

* * * * *